US009282622B2

(12) United States Patent
Draper et al.

(10) Patent No.: US 9,282,622 B2
(45) Date of Patent: Mar. 8, 2016

(54) MODULAR X-RAY SOURCE

(71) Applicant: Moxtek, Inc., Orem, UT (US)

(72) Inventors: Eric Draper, Santaquin, UT (US); Jon Barron, Lehi, UT (US); Vince Jones, Cedar Hills, UT (US); Eric Miller, Provo, UT (US); Dustin Peterson, Spanish Fork, UT (US)

(73) Assignee: Moxtek, Inc., Orem, UT (US)

( * ) Notice: Subject to any disclaimer, the term of this patent is extended or adjusted under 35 U.S.C. 154(b) by 134 days.

(21) Appl. No.: 14/330,976

(22) Filed: Jul. 14, 2014

(65) Prior Publication Data

US 2015/0098552 A1 Apr. 9, 2015

Related U.S. Application Data

(60) Provisional application No. 61/888,407, filed on Oct. 8, 2013.

(51) Int. Cl.
*H05G 1/06* (2006.01)
*H01J 35/12* (2006.01)

(52) U.S. Cl.
CPC .. *H05G 1/06* (2013.01); *H01J 35/12* (2013.01)

(58) Field of Classification Search
CPC ..... H01J 35/00; H01J 35/16; H01J 35/165; H01J 2235/00; H01J 2235/02; H01J 2235/023; H01J 2235/0236; H05G 1/00; H05G 1/02; H05G 1/025; H05G 1/04; H05G 1/06; H05G 1/08; H05G 1/10
USPC ..... 378/119, 121, 122, 141, 142
See application file for complete search history.

(56) References Cited

U.S. PATENT DOCUMENTS

| | | | | |
|---|---|---|---|---|
| 5,949,849 | A | 9/1999 | Hirano et al. | |
| 5,970,117 | A | 10/1999 | Basinger | |
| 7,376,218 | B2 * | 5/2008 | Chapin | H05G 1/04 378/119 |
| 7,660,097 | B2 | 2/2010 | Lee | |
| 8,817,950 | B2 * | 8/2014 | Hansen | H01R 13/53 378/101 |
| 2002/0168050 | A1 | 11/2002 | Ochiai et al. | |
| 2005/0190883 | A1 | 9/2005 | Suzuki et al. | |
| 2010/0002842 | A1 | 1/2010 | Kerpershoek et al. | |
| 2013/0163725 | A1 | 6/2013 | Hansen et al. | |

FOREIGN PATENT DOCUMENTS

| | | | |
|---|---|---|---|
| KR | 10/1163513 | B1 | 7/2012 |
| WO | WO 2008/048019 | A1 | 4/2008 |

OTHER PUBLICATIONS

PCT Application No. PCT/US2014/046897: Filing date Jul. 16, 2014; Moxtek, Inc.; International Search Report mailed Oct. 28, 2014.

* cited by examiner

*Primary Examiner* — Jurie Yun
(74) *Attorney, Agent, or Firm* — Thorpe, North & Western, LLP

(57) ABSTRACT

A modular x-ray source in which the x-ray tube is removably attached to a case and power supply by a removable cap.

20 Claims, 13 Drawing Sheets

MODULAR X-RAY SOURCE

CLAIM OF PRIORITY

This claims priority to U.S. Provisional Patent Application No. 61/888,407, filed on Oct. 8, 2013, which is hereby incorporated herein by reference in its entirety.

FIELD OF THE INVENTION

The present application is related generally to x-ray sources.

BACKGROUND

A common x-ray tube and power supply configuration is for both to be integrally joined with continuous, electrically insulative, potting material surrounding the x-ray tube and the power supply. The x-ray tube and the power supply can be surrounded by a case, typically at ground voltage. The electrically insulative material can insulate high voltage components of the x-ray tube and the power supply from the case. A reason for integrally joining the x-ray tube and the power supply in this manner is that a large voltage differential of several kilovolts can exist between high voltage components (e.g. cathode, wires connecting the cathode to the power supply, and some power supply components) and the case, and it is difficult to have a removable connection between the x-ray tube and the power supply without failure caused by arcing.

A problem of an integrally joined x-ray tube and power supply is that if one of these two devices fails, both must normally be scrapped. It would be beneficial to have a removable connection between the x-ray tube and the power supply so that the two may be connected and disconnected at will, allowing replacement of one of these devices upon failure while saving the other device—if this could be done with minimal risk of failure by arcing.

It would also be beneficial to allow easy removal and replacement of the x-ray tube. If the x-ray tube is removable, and there are multiple, different x-ray tubes matched to specific power supplies, it would be beneficial to have a mechanism for ensuring that the user correctly matches the x-ray tube to the power supply. Other important features of x-ray supplies include providing x-ray shielding to users and heat transfer of heat generated at the x-ray tube anode or electronic components in order to avoid heat-stress failure.

For example of efforts to solve these or related problems, see U.S. Pat. Nos. 5,949,849 and 7,660,097; U.S. Patent Publication Number 2013/0163725; Korean Patent Number KR 10 1163513; and International Patent Publication Number WO2008/048019.

SUMMARY

It has been recognized that it would be advantageous to have an x-ray tube that is easily removable and replaceable with an associated power supply, with reduced risk of failure caused by arcing. It has also been recognized that it would be advantageous to correctly match the x-ray tube to the power supply, to provide x-rays shielding to users, and to provide good heat transfer away from electronics and the anode, in order to avoid heat-stress failure of these components. The present invention is directed to various embodiments of x-ray sources that satisfy these needs. Each embodiment may satisfy one, some, or all of these needs.

The x-ray source comprises an x-ray tube and a power supply carried by an electrically-conductive case. An exterior of the case can include a socket. An electrically-conductive cap can attach to an anode of the x-ray tube and can carry the x-ray tube. The cap can be removably received at the socket of the case, forming an electrically and thermally conductive path between the cap and the case and between an anode of the x-ray tube and the cap.

BRIEF DESCRIPTION OF THE DRAWINGS

FIG. 9 also shows the x-ray tube 6 disposed within a hollow center 24 (see FIGS. 2, 5, and 11) of the cap 14, but not extending beyond or through an inner end opening 27 of the cap 14, in accordance with an embodiment of the present invention;

DEFINITIONS

Figure 1:
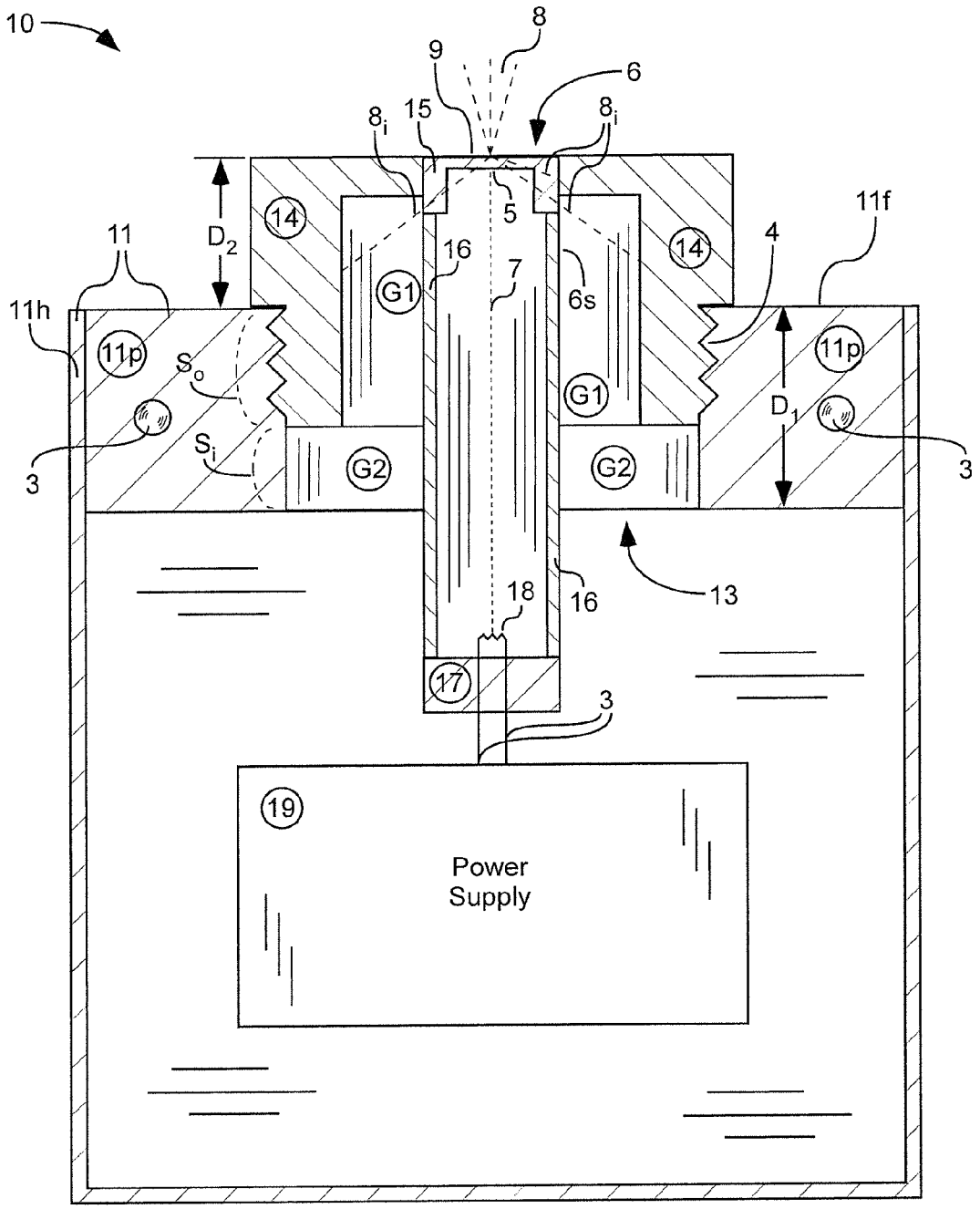
FIG. 1 is a schematic cross-sectional side view of an x-ray source 10, including a removable x-ray tube 6, in accordance with an embodiment of the present invention.

As used herein, the term "evacuated", as in "evacuated enclosure" or "evacuated, electrically-insulative enclosure" for example, refers to an enclosure with a substantial vacuum, such as is typically used for x-ray tubes.

As used herein, the terms "high voltage" or "higher voltage" refer to the DC absolute value of the voltage. For example, negative 1 kV and positive 1 kV would both be considered to be "high voltage" relative to positive or negative 1 V. As another example, negative 40 kV would be considered to be "higher voltage" than 0 V.

DETAILED DESCRIPTION

As illustrated in FIGS. 1-12, x-ray sources 10, 30, 40, 60, 70, 80, 90, 100, and 120 are shown comprising an x-ray tube 6 and a power supply 19 carried by an electrically-conductive case 11. A cap 14 can carry the x-ray tube 6 and can removably connect the x-ray tube 6 to the case 11.

The power supply 19 can be totally, substantially, or at least partially disposed in the electrically-conductive case 11. As shown in FIGS. 1-8 and 10-12, the x-ray tube 6 can be disposed at least partially within the case 11 (including within a socket 13 of the case 11). At least 25% of the x-ray tube 6 can be disposed within the case 11 in one embodiment. At least 50% of the x-ray tube 6 can be disposed within the case 11 in another embodiment. At least 70% of the x-ray tube 6 can be disposed within the case 11 in another embodiment. Between 50% and 90% of the x-ray tube 6 can be disposed within the case 11 in another embodiment. Alternatively, as shown on x-ray source 90 in FIG. 9, the x-ray tube 6 can be disposed mostly or entirely within the cap 14 and the x-ray tube 6 can be disposed entirely outside the case 11 but attached to the case 11 by the cap 14.

Factors such as x-ray tube size, type of x-ray tube electrical connections to the power supply 19, effectiveness of x-ray shielding by the cap 14, desired x-ray source appearance, space available for the x-ray source, and desired protrusion of the cap 14 from the case 11 may be considered in determining how much, if any, of the x-ray tube 6 is disposed in the case 11. Extended cap 14 protrusion from the case 11 can allow easy removal of the x-ray tube 6 and cap 14.

The x-ray tube 6 can include an electrically-insulative enclosure 16 with a cathode 17 and an anode 15 attached to the enclosure 16. The enclosure 16 can be evacuated. The cathode 17 and the anode 15 can be disposed at opposite ends of the enclosure 16. The enclosure 16 can be or can comprise a ceramic material. An electron emitter 18 can be disposed in the enclosure 16 and can be associated with the cathode 17. The electron emitter 18 can be a filament. The electron emitter 18 can be attached to the cathode 17 and can have substantially the same bias voltage as the cathode 17. A target material 5 can be associated with the anode 15 and can be configured to emit x-rays 8 in response to impinging electrons 7 from the electron emitter 18. The target material 5 can be a thin film of a material, such as for example a thin film of silver, gold, or rhodium, and can be disposed on the anode 15.

The electrically-conductive case 11 can include a socket 13 in an exterior or wall thereof. An electrically-conductive cap 14 can carry the x-ray tube 6. The cap 14 can be removably received at or in the socket 13 of the case 11 forming an electrically and thermally conductive path between the cap 14 and the case 11 and between the anode 15 and the cap 14.

The case 11 and the cap 14 carrying the x-ray tube 6 can define a coupling 4 where the cap 14 and the case 11 mate to couple the x-ray tube 6 to the power supply 19. A cap coupling 4*c* can mate with a case coupling/socket coupling 4*s* in order to removably attach the cap 14 and x-ray tube 6 to the case 11. The coupling 4 can allow easy attachment and removal of the x-ray tube 6 from the power supply 19. Thus, if one of these components (x-ray tube 6 or power supply 19) fails, the defective component can be replaced without loss of the other, still-functioning component (power supply 19 or x-ray tube 6).

Figure 6:
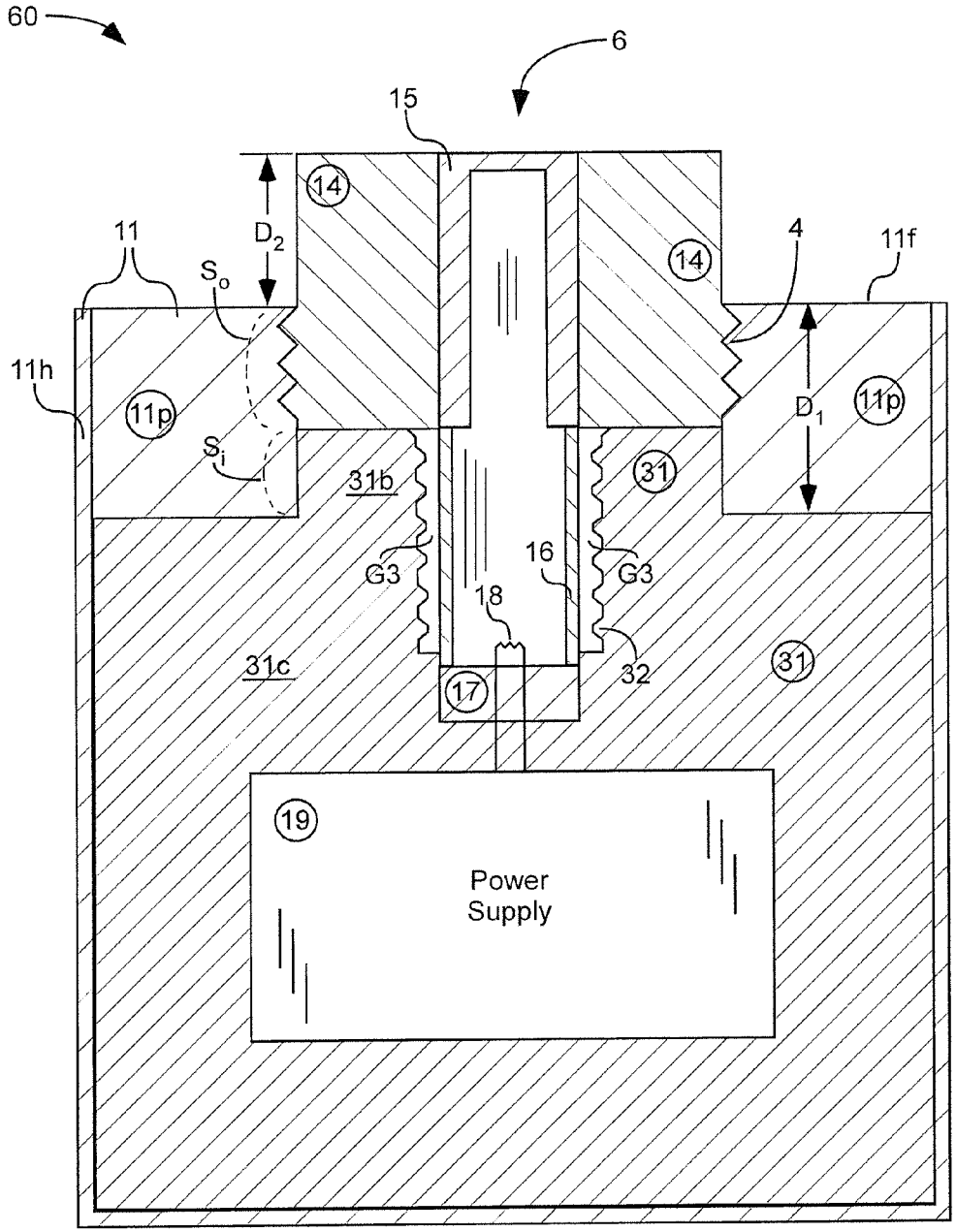
FIG. 6 is a schematic cross-sectional side view of an x-ray source 60, similar to x-ray source 40 shown in FIGS. 4-5, but also including electrically-insulative material 31 to insulate high voltage components from the case 11 and the cap 14, in accordance with an embodiment of the present invention.
Figure 7:
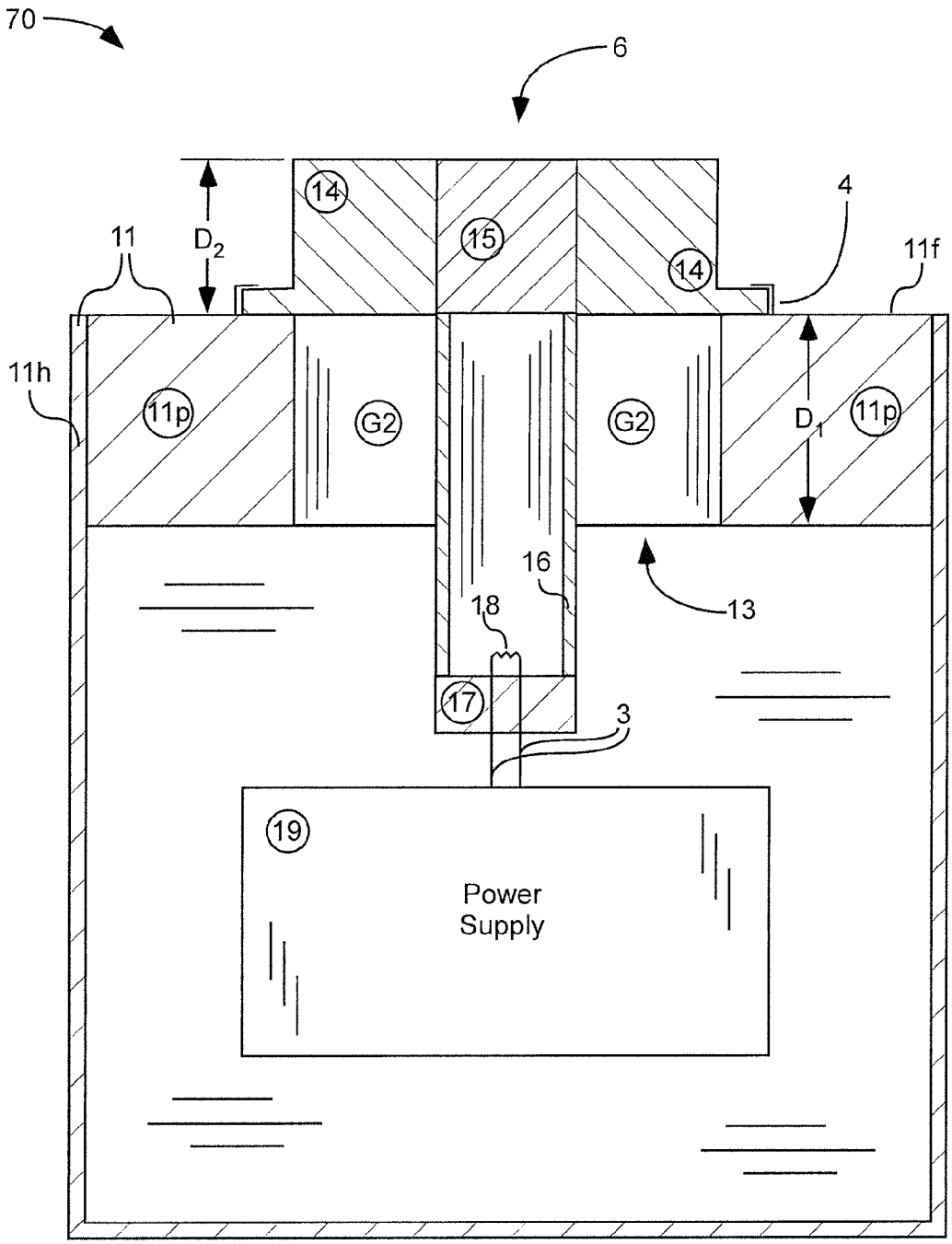
FIGS. 7-9 are schematic cross-sectional side views of x-ray sources 70, 80, and 90, similar to the x-ray sources shown in FIGS. 1-6 and 10-12, but with a different coupling 4 between the cap 14 and the case 11, in accordance with embodiments of the present invention.
Figure 8:
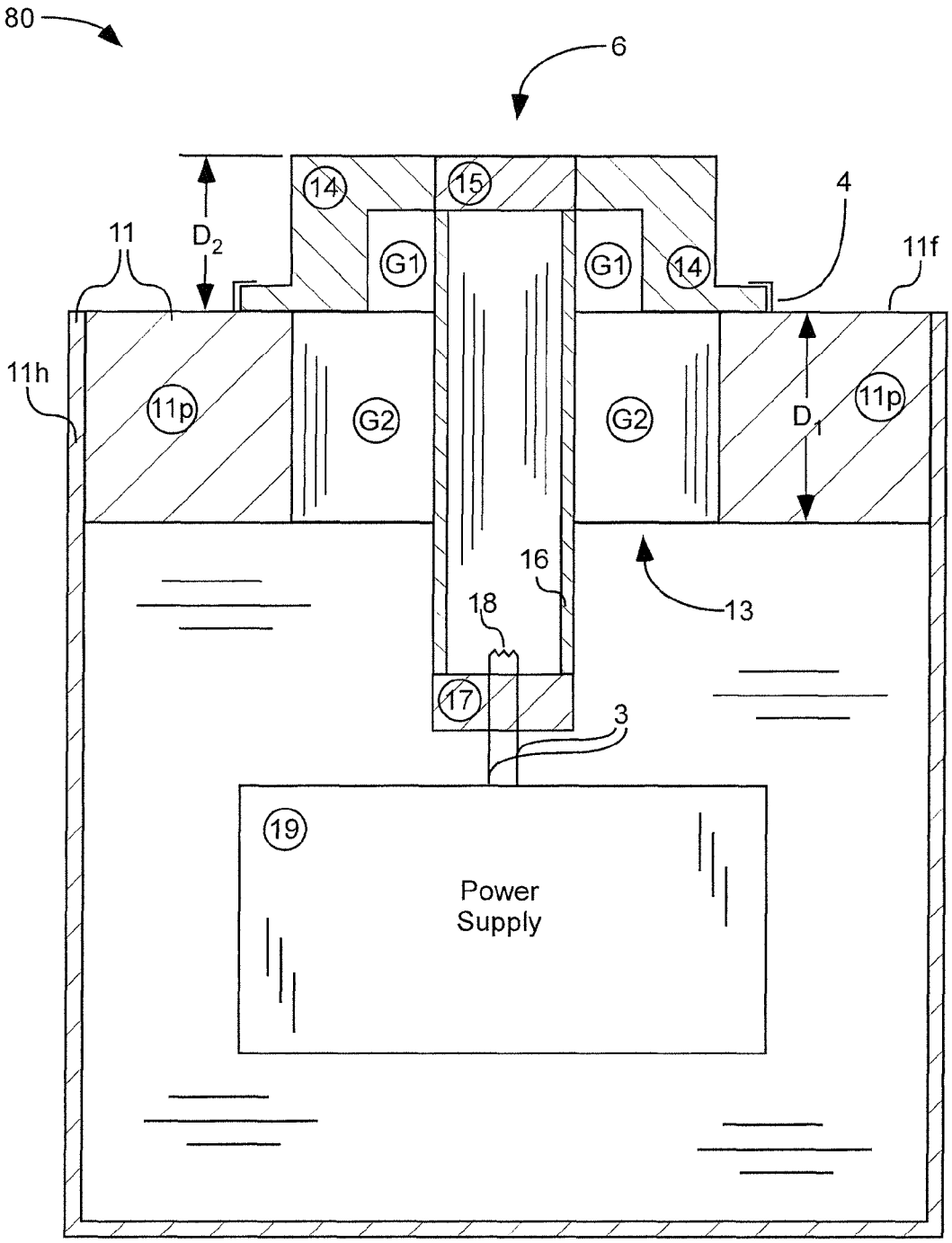
Figure 9:
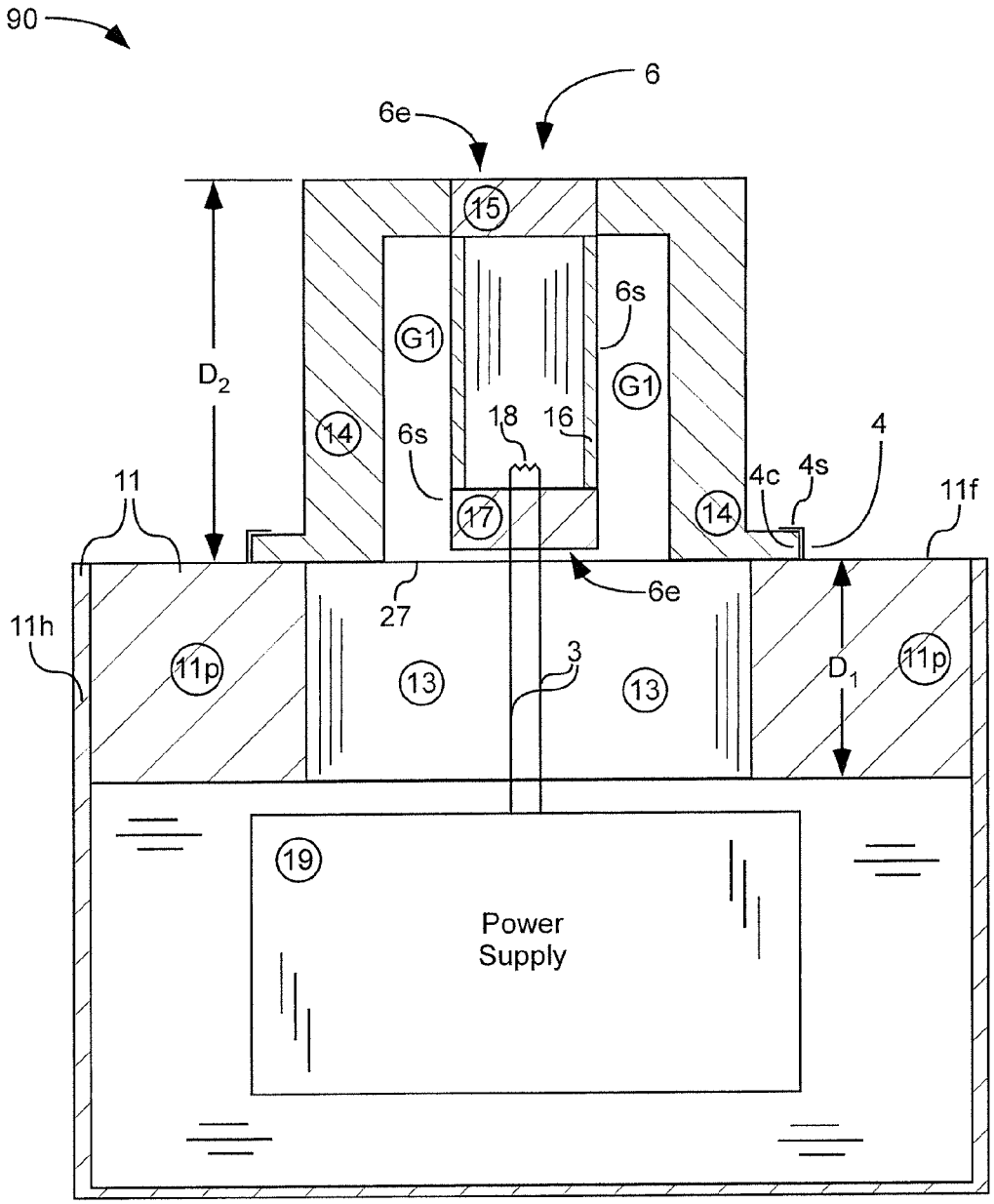

The socket 13 of the case 11 can mate with the cap 14 to form the coupling 4. For example, as shown in FIGS. 1-6 and 10-12, the socket 13 can include female screw threads therein, the cap 14 can include male screw threads thereon, and the cap 14 can be removably received in the socket 13 by a threaded coupling 4. A quarter-turn, BNC-like connector, or press fit may also be used as the coupling 4. Another alternative coupling 4, shown in FIGS. 7-9, is for the cap 14 to mate with or thread onto a connector or case coupling 4*s* on a face 11*f* of the case 11. Thus, in FIGS. 1-12, the cap 14 is removably received at the socket 13, and in FIGS. 1-6 and 10-12 the cap 14 is removably received in the socket 13.

A threaded coupling has an advantage of a potentially large area of contact between the cap 14 and the case 11, thus allowing for a firm connection between x-ray tube 6 and case 11 to hold the x-ray tube 6 firmly in position. A threaded coupling, with a potentially large area of contact between the cap 14 and the case 11, also can have advantages of improved heat transfer from the cap 14 to the case 11, and improved electrical transfer from the cap 14 to the case 11. A good connection for heat and electrical transfer can be important because corrosion or poor fit, which can develop after several connections and removals, can cause an undesirable voltage or temperature differential between the cap 14 and the case 11. Also, the anode can heat up due to a large flux of impinging electrons 7. This heat, if not removed, can cause damage to the x-ray window 9. Other coupling 4 types can have other advantages, such as quicker and easier insertion and removal.

The coupling 4 can be configured to ensure a proper match of x-ray tube 6 to power supply 19. For example, the coupling 4 can have a first configuration when the x-ray tube 6 and power supply 19 are configured for a first bias voltage or a different second configuration when the x-ray tube 6 and power supply 19 are configured for a second bias voltage. The cap 14 and the case 11 in the first configuration will not mate with the case 11 and the cap 14, respectively, of the coupling 4 in the different second configuration. This can prevent incorrect coupling of x-ray tube 6 to power supply 19. There may be more than two configurations. For example, there can be one coupling type for matching a 10 kV x-ray tube to a 10 kV power supply, a different coupling type for matching a 15 kV x-ray tube to a 15 kV power supply, and another coupling type for matching a 25 kV x-ray tube to a 25 kV power supply. The different couplings can be different threads, such as for example standard and reverse threads, or different pitches of threads. Matching indicia on an exterior of the case 11 and an exterior of the cap 14 can also be used to match the x-ray tube 6 to the power supply 19.

Cathode electrical connections 3 can electrically couple the electron emitter 18 of the x-ray tube 6 to the power supply 19. The x-ray tube 6, the cathode electrical connections 3, or the x-ray tube 6 and the cathode electrical connections 3 together, can extend through the socket 13. The x-ray tube 6 can extend into the socket 13, as shown in FIGS. 1-8 and 10-12. The x-ray tube 6 can extend all the way through the socket 13, as shown in FIGS. 1-2, 4-8, and 10-12. The x-ray tube 6 and the cathode electrical connections 3 together can extend through the socket 13, as shown in FIG. 3. The cathode electrical connections 3 can extend into the socket 13, as shown in FIGS. 3 and 9. The cathode electrical connections 3 can extend through the socket 13, as shown in FIG. 9.

Figure 2:
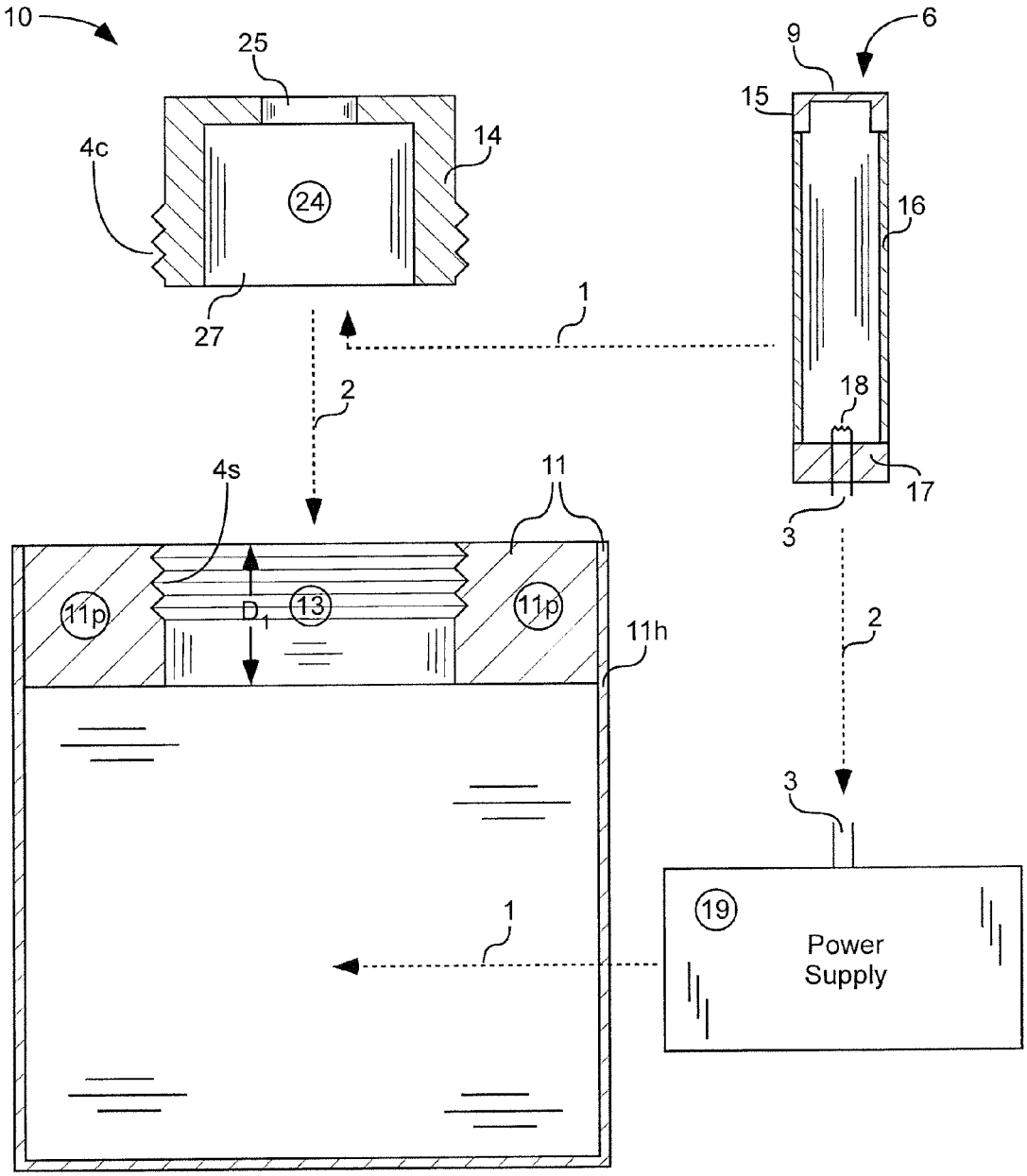
FIG. 2 is a schematic cross-sectional side view of x-ray source 10, showing individual components separately (case 11, cap 14, x-ray tube 6, and power supply 19), in accordance with an embodiment of the present invention.
Figure 3:
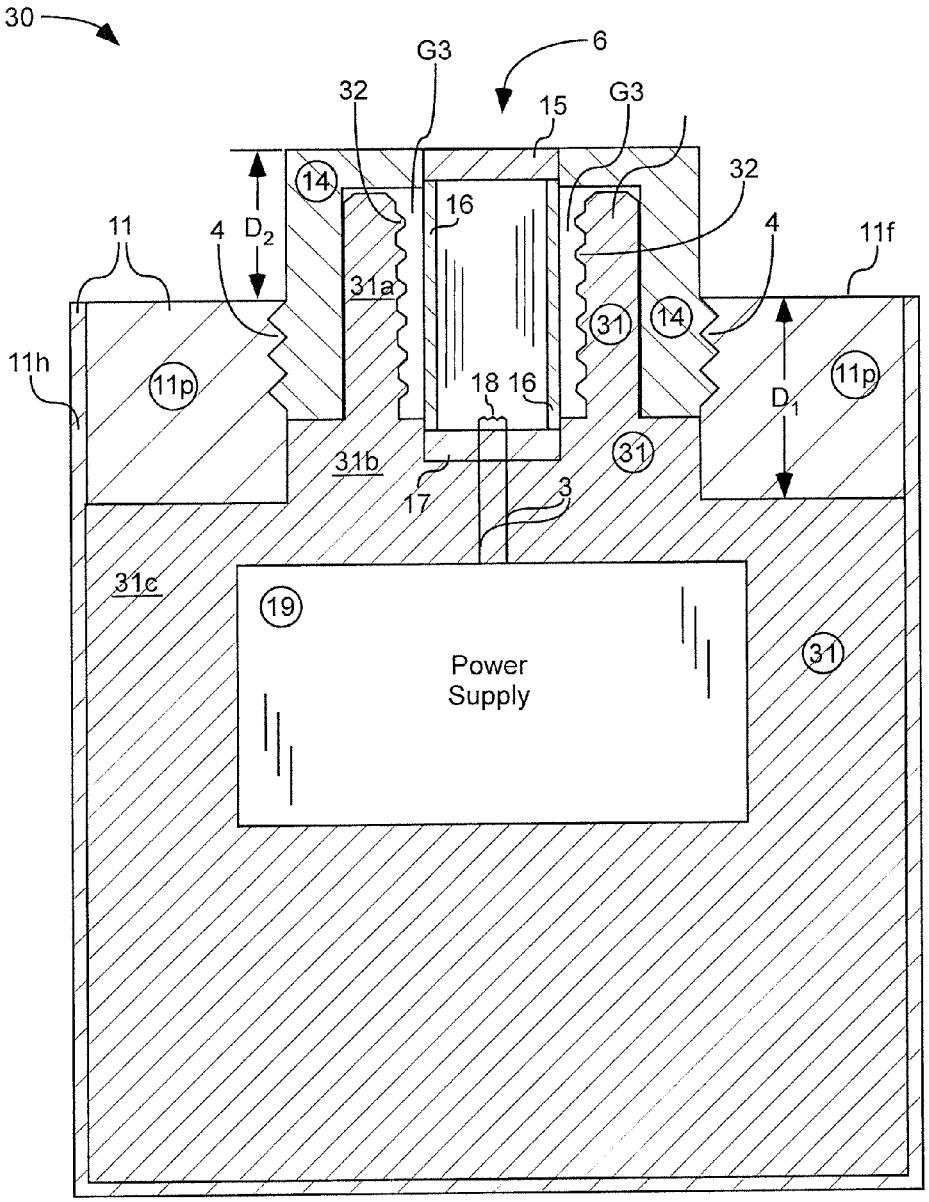
FIG. 3 is a schematic cross-sectional side view of an x-ray source 30, similar to x-ray source 10 shown in FIGS. 1-2, but also (1) including electrically-insulative material 31 to insulate high voltage components from the case 11 and the cap 14, and (2) the x-ray tube extends only partially through a socket 13 of the case 11, in accordance with an embodiment of the present invention.
Figure 4:
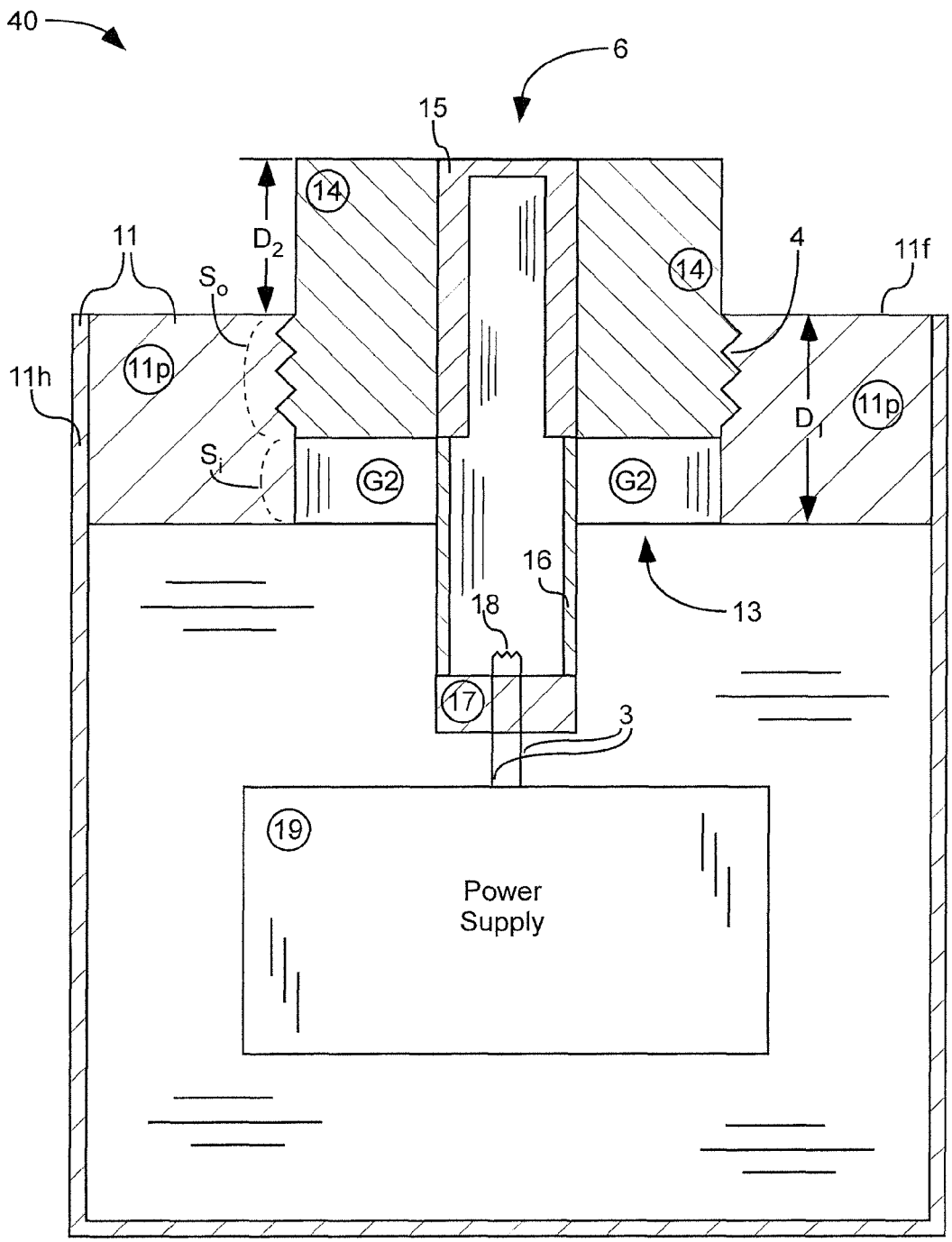
FIG. 4 is a schematic cross-sectional side view of an x-ray source 40, similar to the x-ray sources 10 & 30 shown in FIGS. 1-3, except that there is no first annular gap G1 between the cap 14 and the x-ray tube 6, in accordance with an embodiment of the present invention.
Figure 5:
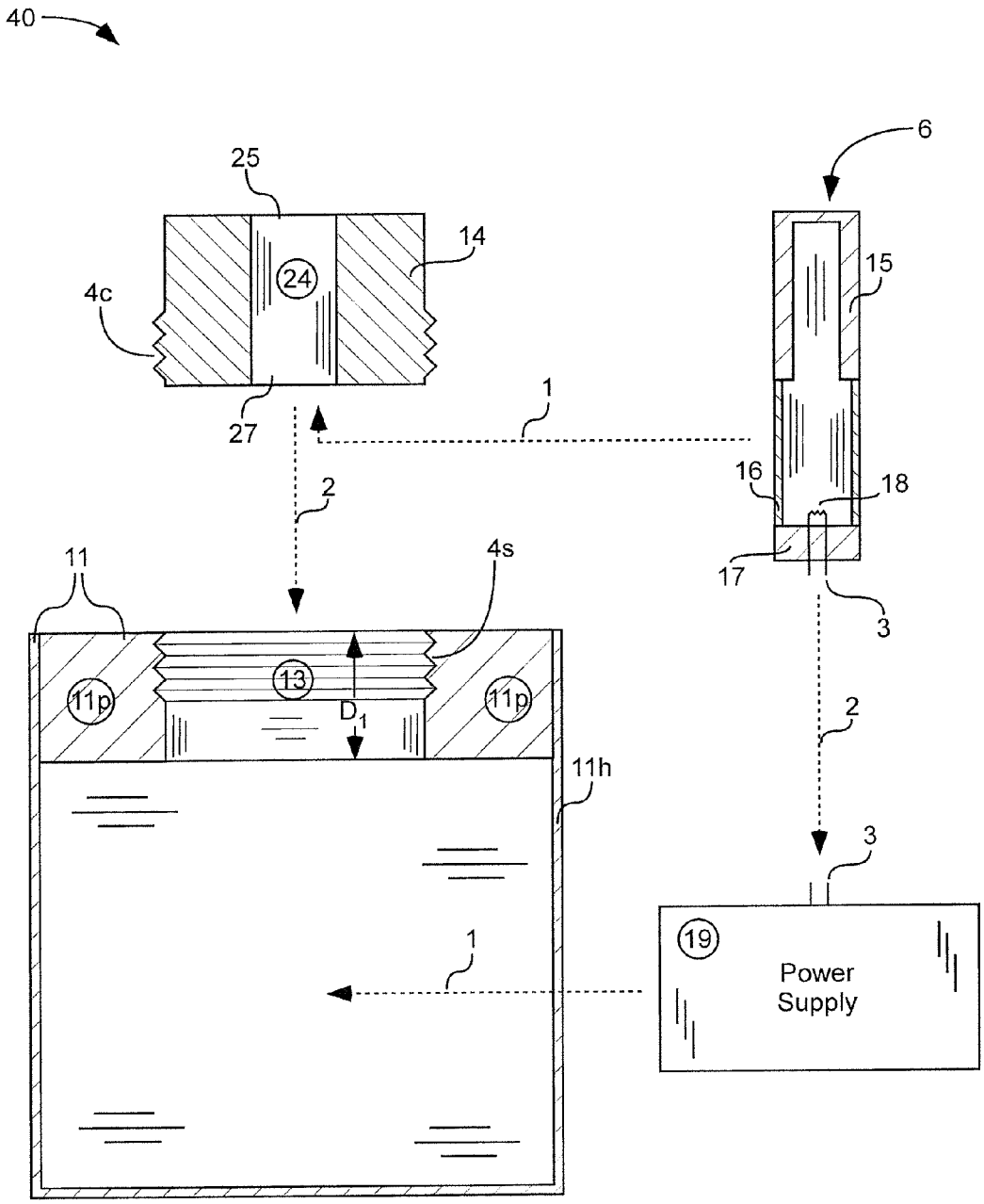
FIG. 5 is a schematic cross-sectional side view of x-ray source 40, showing individual components separately (case 11, cap 14, x-ray tube 6, and power supply 19), in accordance with an embodiment of the present invention.
Figure 10:
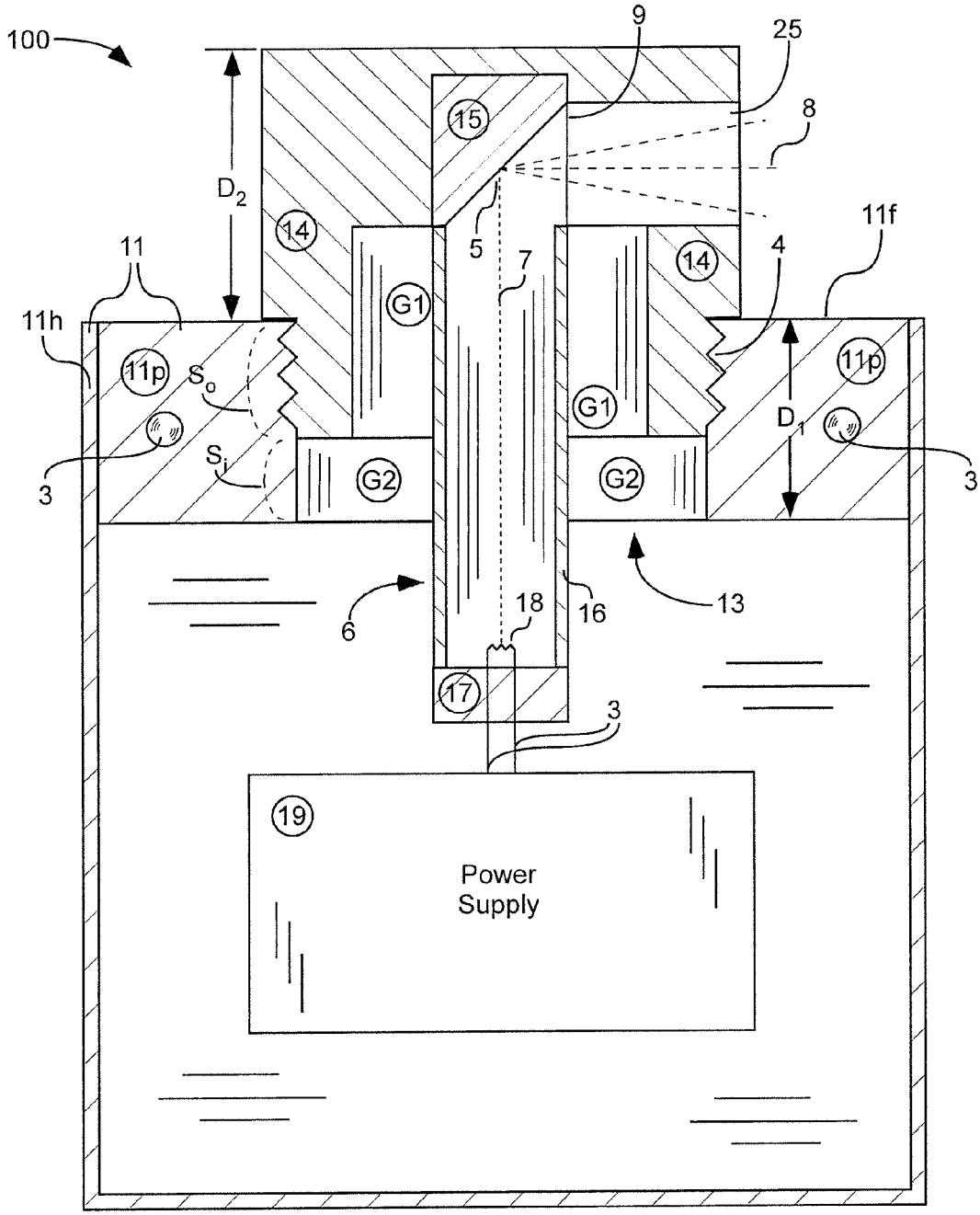
FIG. 10 is a schematic cross-sectional side view of an x-ray source 100, similar to the x-ray sources shown in FIGS. 1-9, except that x-ray source 100 is a side-window x-ray source, in accordance with an embodiment of the present invention.
Figure 11:
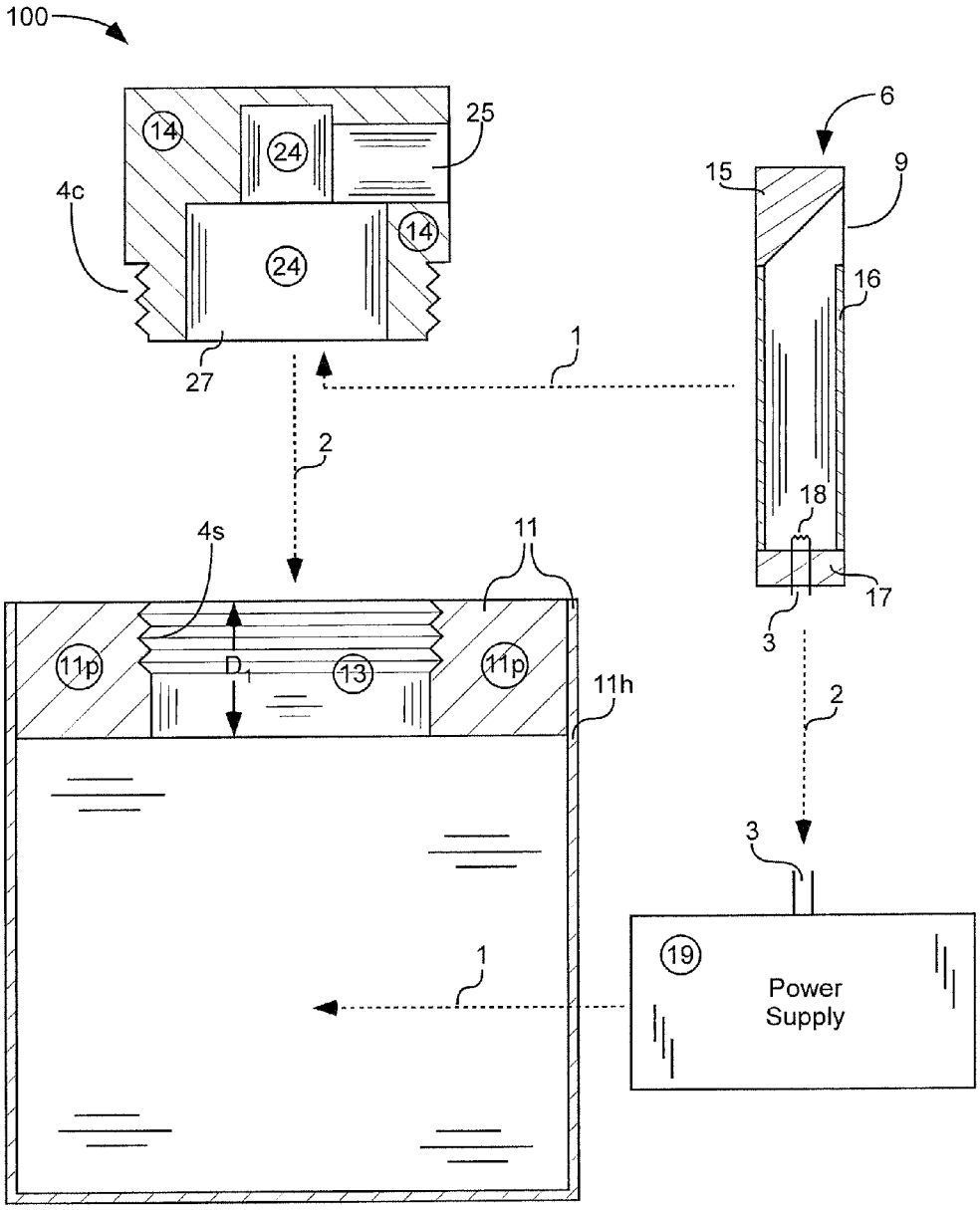
FIG. 11 is a schematic cross-sectional side view of x-ray source 100, showing individual components separately (case 11, cap 14, x-ray tube 6, and power supply 19), in accordance with an embodiment of the present invention.

The cap 14 can be elongated and annular and can have a hollow center 24 (see FIGS. 2, 5, and 11). The cap 14 can include an outer end opening 25 and an inner end opening 27. As shown in FIGS. 1-12, the x-ray tube 6 can extend into or through the hollow center 24; the cap 14 can carry the x-ray tube 6; and the cap 14 can be attached to the x-ray tube 6 at the anode 15. The attachment between the anode 15 and the cap 14 can form a thermally and electrically conductive path, thus allowing heat to transfer from the anode 15 to the cap 14, and to maintain both at a common or ground voltage.

A portion of the x-ray tube 6 can extend through the hollow 24 of the cap 14 towards the inner end opening 27 (see FIGS. 1-12). A portion of the x-ray tube 6 can extend through the hollow 24 of the cap 14 and through the inner end opening 27 (see FIGS. 1-8 and 10-12).

As shown on x-ray source 90 in FIG. 9, the x-ray tube can be substantially surrounded by the cap 14. The cap 14 can surround the x-ray tube 6 on sides 6*s* but necessarily not on the two ends 6*e*. A portion of the x-ray tube 6, such as the enclosure 16 and the cathode 17, can extend through the hollow 24 of the cap 14 towards but not through the inner end opening 27 of the cap 14. Also, as shown on x-ray source 90 in FIG. 9, electrical connections between the x-ray tube 6 and the power supply 19 can extend both into and through the socket 13. In contrast, the x-ray tube 6 in x-ray sources 10, 40, 60, 70, 80, 100, and 120 can extend both into and through the socket 13; and the x-ray tube 6 and the cathode electrical connections 3 together can extend through the socket 13 in x-ray source 30. Factors that can be used in determining how much of the x-ray tube 6, if any, extends into or through the socket 13 include desired x-ray tube length, desired cap 14 length, and desired coupling 4 type.

As shown in FIG. 1, x-ray tubes can emit x-rays 8, not only through the x-ray window 9, but also through sides 6*s* of the x-ray tube 6. It can be important to shield users from these stray x-rays $\mathbf{8}_i$ emitted through sides 6*s* of the x-ray tube 6. The cap 14, by proper selection of material and thickness, can block these impinging, stray x-rays $\mathbf{8}_i$, and thus protect the user. The cap 14 can block 99.9% of all impinging x-rays $\mathbf{8}_i$ having energy of less than 20 KeV in one aspect or 99% of all impinging x-rays $\mathbf{8}_i$ having energy of less than 20 KeV in another aspect. The actual amount of x-rays $\mathbf{8}_i$ blocked can depend on cap 14 thickness and material and impinging x-ray $\mathbf{8}_i$ energy. The desired amount of impinging x-rays $\mathbf{8}_i$ blocked can depend on x-ray energy, user proximity to the x-ray source, and whether there are other surrounding materials to block the x-rays $\mathbf{8}_i$.

The x-ray tube 6 can be oriented to direct x-rays 8 through or outward from the outer end opening 25. For example, as shown in FIGS. 1-9, the x-ray tube 6 can be a transmission-target type and the cap 14 can carry or be attached to the anode 15 at the outer end opening 25. The anode 15 can fill or substantially fill the outer end opening 25. Although not shown in the figures, the x-ray tube 6 can be recessed lower than the outer end opening 25. The inner end opening 27 can be at one end of the cap 14 and the outer end opening 25 can be at an opposite end of the cap 14.

Figure 12:
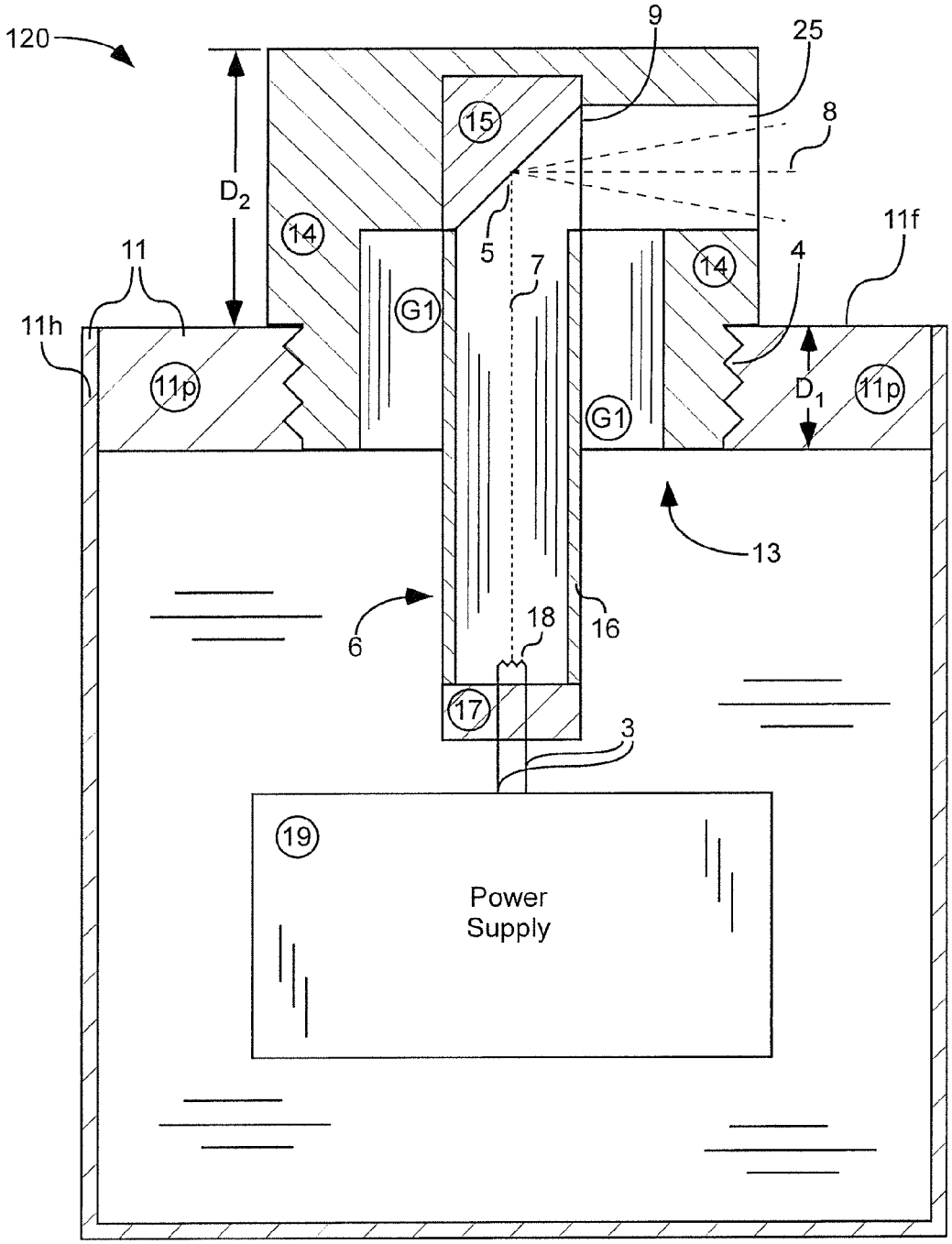
FIG. 12 is a schematic cross-sectional side view of an x-ray source 120, similar to x-ray sources shown in the previous figures, but showing that the cap 14 can fill the socket and showing an absence of the second annular gap G2, in accordance with an embodiment of the present invention.

Alternatively, as shown in FIGS. 10-12, the x-ray tube 6 can be a side-window type. The cap 14 can carry or can be attached to the anode 15, but not at the outer end opening 25. X-rays 8 can be directed through the window 9 and out through or from the outer end opening 25. The outer end opening 25 can be disposed at a side of the cap 14.

As shown in FIGS. 1-3 and 8-12, a first annular gap G1 can separate a portion of the x-ray tube 6 from a portion of the cap 14. The first annular gap G1 can provide electrical insulation between the portion of the cap 14 and the portion of the x-ray tube 6. Alternatively, as shown in FIGS. 4-7, the x-ray tube 6, and particularly the anode 15, can totally or substantially fill the hollow center 24 of the cap 14. A choice between the designs of FIGS. 1-3 and 8-12 or the designs of FIGS. 4-7 can be made depending on a depth of the cap 14 and a length of the anode 15. Cap 14 overall depth can depend on a distance $D_2$ that the cap 14 extends beyond an outer face 11*f* of the case 11 and desired coupling 4 type. The desired length of the anode 15 can depend on x-ray focusing requirements and overall x-ray tube 6 design.

As shown in the figures, the x-ray tube 6 and the cap 14 can extend beyond a face 11*f* of the case 11 to allow easy removal of the cap 14 and x-ray tube 6. This can allow a user to easily replace the x-ray tube 6 or power supply 19 in case of failure of one of these components. The cap 14 can extend beyond an outer face 11*f* of the case 11 for a sufficient distance $D_2$ to allow removal of the cap 14 by grasping the cap 14 and turning by hand without tools. The cap 14 can extend beyond an outer face 11*f* of the case 11 for a distance $D_2$ of at least 3 millimeters in one aspect, for a distance $D_2$ of at least 4 millimeters in another aspect, for a distance $D_2$ of at least 6 millimeters in another aspect, or for a distance $D_2$ of at least 9 millimeters in another aspect.

All or part of the case 11 can be made of sheet metal (e.g. about 1 mm thickness). It can be beneficial for a region of the case 11 in which the socket 13 is disposed to be thicker than other parts of the case. This thicker region can be called a face plate 11*p*.

A first benefit of a relatively thicker face plate 11*p* is to allow space for coupling 4 the cap 14 to the face plate 11*p*. This can especially be important if the coupling 4 is a threaded coupling with the cap threading into the socket 13 of the face plate 11*p*. A second benefit of a relatively thicker face plate 11*p* is to provide a strong support for attachment of the cap 14 and x-ray tube 6. A third benefit of a thicker face plate 11*p* is increased heat capacity. This increased heat capacity can allow for improved heat transfer from the anode 15 through the cap 14 to the face plate 11*p*, thus reducing anode 15 temperature and reducing the risk of damage to the x-ray window 9. A fourth benefit of a relatively thicker face plate 11*p* is that a thicker face plate 11*p* can allow space for drilling mounting holes 3 into or through the face plate 11*p*. These mounting holes 3 can be used to mount the x-ray source to a mount or support, such as a support bracket or wall. The mounting holes 3 can include female threads for attachment to the mount. Disadvantages of a thicker face plate 11*p* can include increased material cost and increased x-ray source weight. The advantages of a thicker face plate 11*p* can be weighed against the disadvantages in each specific x-ray source design.

A thickness of the face plate 11*p* can be the same as a depth and the socket. The socket 13 can have a depth $D_1$ of at least 4 millimeters in one aspect, a depth $D_1$ of at least 8 millimeters in another aspect, a depth $D_1$ of at least 10 millimeters in another aspect, or a depth $D_1$ of at least 15 millimeters in another aspect.

Another portion of the case 11, called a housing 11*h*, can include at least four contiguous side walls. The housing 11*h* can substantially circumscribe the power supply 19 with at least four contiguous side walls. The contiguous side walls of the housing 11*h* can also circumscribe at least a portion of the x-ray tube 6.

The face plate 11*p* can be disposed at an open end of the contiguous side walls of the housing 11*h*. The face plate 11*p* and the housing 11*h* can be made from a single piece of metal, such as by machining, but this can be expensive. Thus, for saving manufacturing cost, the housing 11*h* can be sheet metal (e.g. about 1 mm thickness) folded into the correct shape. The face plate 11*p* can be manufactured separately (e.g. cut to shape from a thicker piece of metal) from the housing 11*h* then attached to the side walls of the housing 11*h*. The term "attached to" as used herein in reference to the face plate 11*p* and housing 11*h* means that the face plate 11*p* is manufactured separately (e.g. the face plate is cut to shape and the housing bent to shape) then attached to the housing 11*h*, such as by welding, fasteners, or an adhesive for example.

The first annular gap G1, between the cap 14 and the x-ray tube 6, can be filled with air in one aspect. Alternatively, as shown in FIG. 3, an annular, electrically-insulative, solid plug 31*a* can be disposed in the first annular gap G1. The plug 31*a* can fill, substantially fill, or partially fill the first annular gap G1. The plug 31*a*, or material of the plug 31, can have an electrical resistance greater than air. The air and/or the plug can electrically insulate the cap 14 from a portion of the x-ray tube 6. The plug 31*a* can be attached or sealed to the case 11 and can remain with case 11 when the cap 14 and x-ray tube 6 are removed from the case 11.

As shown in FIGS. 1, 4, 6 and 10, a region of the socket 13 extending from an exterior of the case 11 partially towards an interior of the case 11 defines an outer region $S_o$. A region of the socket 13 extending from the interior of the case 11 partially towards the exterior of the case 11 defines an inner region $S_i$. A relatively large depth $D_2$ of the socket, to allow for heat transfer and mounting, can result in having both an outer region $S_o$ and an inner region $S_i$. The cap 14 can be disposed at the outer region $S_o$ of the socket 13. The x-ray tube 6 can extend from the cap 14, through the outer region, and into or through the inner region $S_i$.

A second annular gap G2 can exist between the x-ray tube and the case 11. As shown in FIGS. 1-6 and 10, if the x-ray tube 6 extends into or through the inner region $S_i$, then the second annular gap G2 can separate the x-ray tube 6 from the case 11 at the inner region S. As shown in FIGS. 7-8, there can also be a second annular gap G2 between the x-ray tube 6 and the case 11 even if the cap 14 is attached to a face 11*f* of the case 11, the cap 14 does not extend into the socket 13, and the socket is not divided into an outer region $S_o$ and an inner region $S_i$. As shown in FIG. 7, there can be a second annular gap G2 without a first annular gap G1.

An annular, electrically-insulative, solid plug 31*b* can be disposed in, can extend into, or can extend through the second annular gap G2. The plug 31*b* in the second annular gap G2 can electrically insulate a portion of the x-ray tube 6 from the case 11 at the inner region $S_i$, can electrically insulate a portion of the x-ray tube 6 from the case 11 in the socket 13, and/or can be an extension of the plug 31*a* in the first annular gap G1 and thus can be made of the same electrically-insulative material 31 as the plug 31*a* in the first annular gap G1. The plugs 31*a* and 31*b* can be attached or sealed to the case 11 and can remain with case 11 when the cap 14 and x-ray tube 6 are removed from the case 11.

FIGS. 1-8 and 10-11 show x-ray sources with a second annular gap G2 (air-filled or filled at least partially with a solid electrically-insulative material 31*b*). As shown in FIG. 9, the second annular gap G2 may be avoided by disposing the x-ray tube entirely within the cap 14. As shown in FIG. 12, the second annular gap G2 may be avoided by having a longer cap 14 which extends all the way through the socket 13, or by reducing the depth $D_1$ of the socket 13. A possible advantage of eliminating the second annular gap G2 is that there can be a reduced risk of arcing between the x-ray tube 6 and the case 11. The second annular gap G2 is a natural result of increased face plate 11*p*/socket depth $D_1$. Several advantages of a thicker face plate 11*p* were mentioned previously.

The electrically-insulative material 31 can extend around and can provide electrical insulation 31*c* between all or a portion (at least a portion) of the power supply 19 and the case 11. The electrically-insulative material 31 can be attached or sealed to the case 11, can be attached or sealed to the power supply 19, and/or can remain with case 11 when the cap 14 and x-ray tube 6 are removed from the case 11.

The electrically-insulative material 31 can be used to transfer heat away from the x-ray tube 6 and/or electronic components in the power supply 19. This improved heat transfer can reduce stress and instability of electronic components. Thus, the electrically-insulative material 31 can have a relatively high thermal conductivity. For example, the electrically-insulative material 31 can have a thermal conductivity of greater than $$0.5\frac{W}{m*K}$$

in one aspect, a thermal conductivity of greater than $$0.7\frac{W}{m*K}$$

in another aspect, a thermal conductivity of greater than $$0.9\frac{W}{m*K}$$

in another aspect, or a thermal conductivity of between than $$0.9\frac{W}{m*K} \text{ and } 1.5\frac{W}{m*K}$$

in another aspect.

A very high level of electrical insulation between the x-ray tube 6 and the cap 14 can be achieved by having a third annular gap G3 which is free of solid material (typically air-filled) between the plug 31*a* and the x-ray tube 6. As shown in FIGS. 3 and 6, there can be ribs 32 on an interior surface of the electrically-insulative material 31 facing the x-ray tube 6. These ribs 32 can improve electrical resistance. This improved electrical resistance can be accomplished by increasing a distance along a surface of the plug along which electrons must travel between the anode 15 and cathode 17. This design can provide very good electrical insulation between the x-ray tube 6 and the cap 14 and case 11. In order to avoid arcing failure, an electrically-insulative material 31 can be chosen that has a higher electrical resistance than air; ribs 32 can be formed along the electrically-insulative material 31 to increase surface distance; and the gap G3 can prevent trapping air in small pockets. Trapping air in small pockets can be undesirable because the air in such small pockets can ionize due to a high voltage gradient, thus reducing the electrical resistance of the air.

The ribs 32 and the third annular gap G3 can be disposed between the x-ray tube 6 and the plug 31*a* in the first annular gap G1 region. The ribs 32 and the third annular gap G3 can also or alternatively be disposed between the x-ray tube 6 and the plug 31*b* in the second annular gap G2 region. The ribs 32 and the third annular gap G3 can also or alternatively be disposed between the x-ray tube 6 and the plug 31*c* in the region inside the case 11 (not in the socket 13).

FIGS. 2, 5, 11 show individual components separately (case 11, cap 14, x-ray tube 6, and power supply 19). Manufacture or assembly can include a first step 1 and a second step 2. The first step 1 can include installing the power supply 19 in the case 11 and installing the x-ray tube 6 in the cap 14. The second step 2 can include assembly of the components—attaching the cap 14 to the case 11 (per coupling 4 as described previously) and electrically connecting the x-ray tube 6 to the power supply 19 through the cathode electrical connections 3.

As part of the first step 1, the power supply 19 can be installed in or attached to the case 11. Electrically insulative potting material 31 can then be poured into the area surrounding the power supply 19 within the case 11 and/or desired areas of the socket 13, then cured to harden. A spacer plug can be used as a temporary filler to save room for later insertion of the cap 14 and x-ray tube 6. A non-stick spray on the spacer plug may be used to allow separation of the spacer plug from the cured potting.

Also as part of the first step 1, the x-ray tube 6 can be connected to the cap 14, which can be done by various means. For example, the x-ray tube 6 can be connected to the cap 14 by a set screw, which can allow reuse of the cap 14 if the x-ray tube 6 fails. The x-ray tube 6 can be connected to the cap 14 by an adhesive, such as for example an adhesive comprising silver suspended in a resin. An adhesive can provide a very sturdy attachment which can limit x-ray tube 6 movement or vibration with respect to the cap 14.

Figure 13:
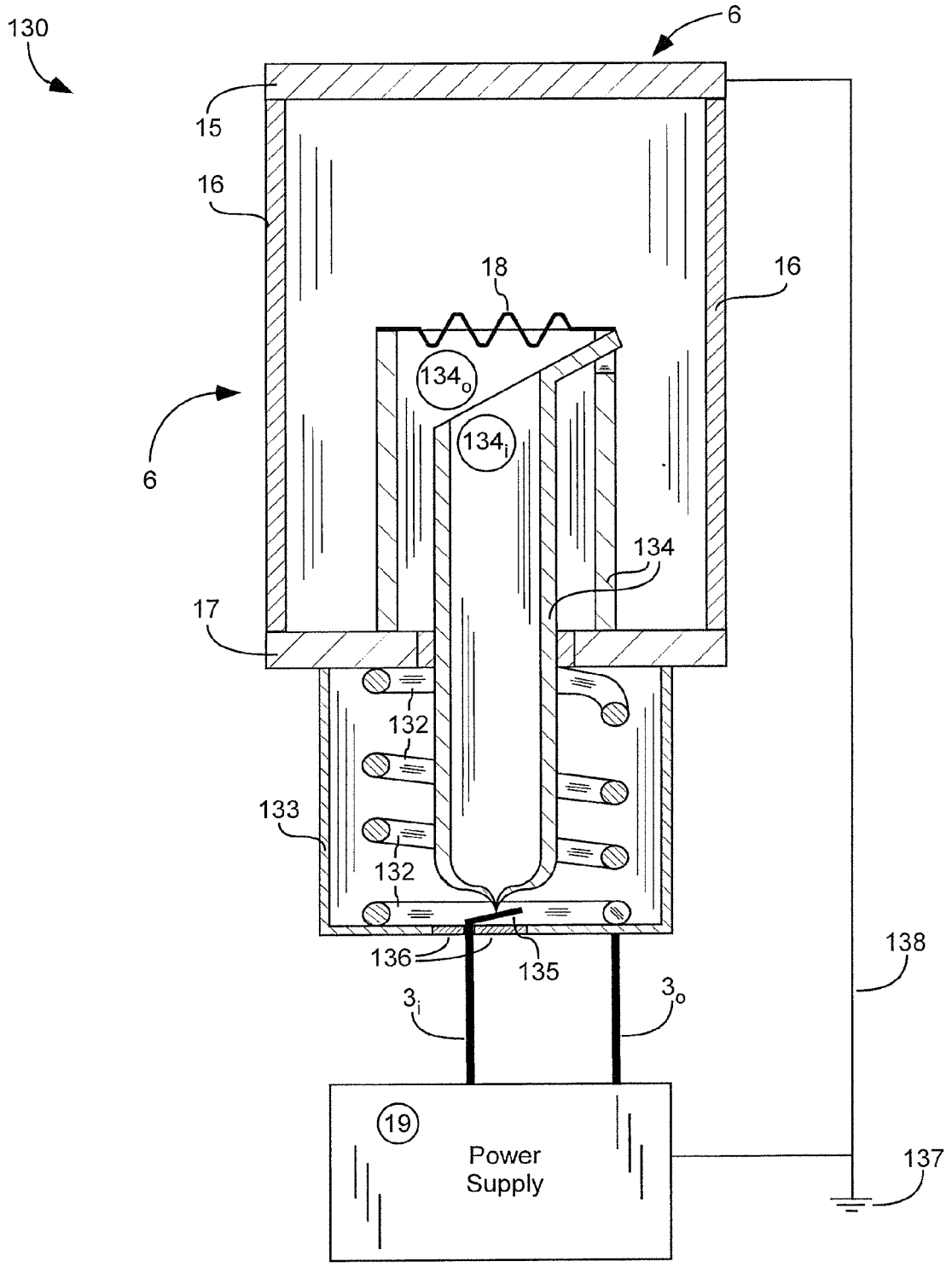
FIG. 13 is a schematic cross-sectional side view of an x-ray source 130, illustrating one method of removably connecting the x-ray tube 6 to the power supply 19, in accordance with an embodiment of the present invention.

Included in step 2 is coupling 4 the cap 14 to the case 11, which was described previously, and removably attaching the x-ray tube 6 to the power supply 19. One option for removably attaching the x-ray tube 6 to the power supply 19 is shown on x-ray source 130 in FIG. 13, and is described in more detail in patent application Ser. No. 14/325,896, filed on Jul. 8, 2014, which is incorporated herein by reference. Dual-concentric emitter tubes 134, including an inner tube $\mathbf{134}_i$ and an outer tube $\mathbf{134}_o$, can be used as electron emitter 18 supports. The inner tube $\mathbf{134}_i$ and the outer tube $\mathbf{134}_o$ can also form part of the cathode electrical connections 3.

The cathode electrical connections 3 can also include a first power supply connection $\mathbf{3}_i$ and a second power supply connection $\mathbf{3}_o$. The inner tube $\mathbf{134}_i$ can make electrical connection to the first power supply connection $\mathbf{3}_i$ by various means, such as by a leaf spring 135. The outer tube $\mathbf{134}_o$ can make electrical connection to the second power supply connection $\mathbf{3}_o$ by various means, including a helical spring 132. The helical spring 132 can be substantially or totally enclosed within an electrically-conductive cup 133 that is capped off with the cathode 17. The cup 133 can act as a corona guard to shield sharp edges of the helical spring 132, the leaf spring 135, and/or the dual-concentric emitter tubes 134. The corona-guard cup 133 can help to prevent arcing between these components and surrounding or near-by components. An electrical connection for the leaf spring 135 (or other electrical connection for the inner tube $\mathbf{134}_i$) can enter the cup 133 through an electrically insulative region 136 of the cup 133 or by an electrically insulated wire $\mathbf{3}_i$.

The power supply 19 can provide a third electrical connection 138 to the anode 15. This third electrical connection 138 can be made from the power supply 19 to the case 11, then from the case 11 to and through the cap 14 to the anode 15. This third electrical connection 138 can be ground electrical potential 137. Thus, the cap 14, the anode 15, and the case 11 can be, or can be configured to be, maintained at ground voltage 137.

The power supply 19 can provide a voltage (typically a few volts) across the first and second cathode electrical connections $\mathbf{3}_i$ and $\mathbf{3}_o$ to cause an electrical current to flow through and to heat the electron emitter 18. The power supply 19 can provide a large bias voltage, such as several kilovolts, between the cathode electrical connections 3 and the third electrical connection 138 to the anode 15. The cathode electrical connections 3 can have a bias voltage of negative tens of kilovolts. The heat of the electron emitter 18 and the large bias voltage between the electron emitter 18 and the anode 15 can cause electrons 7 to be propelled from the electron emitter 18 towards the anode 15. Impinging electrons 7 on the target material 5 of the anode 15 can cause x-rays 8 to emit from the x-ray source.

What is claimed is:

1. An x-ray source comprising:

a. an x-ray tube and a power supply carried by and at least partially disposed in an electrically-conductive case;

b. the x-ray tube including:

i. an electrically-insulative enclosure with a cathode and an anode attached to the enclosure;

ii. an electron emitter disposed in the enclosure and associated with the cathode; and iii. a target material associated with the anode and configured to emit x-rays in response to impinging electrons from the electron emitter;

c. the electrically-conductive case including a socket in an exterior thereof, the socket having a depth of at least 8 millimeters;

d. the x-ray tube extending into the socket;

e. an electrically-conductive cap:

i. carrying the x-ray tube;

ii. removably received in the socket of the case forming an electrically and thermally conductive path between the cap and the case;

iii. being elongated and annular with a hollow therein; and iv. having an outer end opening and an inner end opening;

v. extending beyond an outer face of the case for a distance of at least 3 millimeters to allow removal of the cap by grasping the cap and turning by hand without tools;

f. the anode of the x-ray tube attached to the cap and forming a thermally and electrically conductive path between the cap and the anode;

g. the x-ray tube oriented to direct x-rays outward from the outer end opening;

h. a portion of the x-ray tube extending through the hollow of the cap towards the inner end opening with a first annular gap separating a portion of the x-ray tube from a portion of the cap and providing electrical insulation between the portion of the cap and the portion of the x-ray tube;

i. an annular, electrically-insulative, solid plug disposed in the first annular gap between the x-ray tube and the cap;

j. material of the plug is an electrically-insulative material and extends around and provides electrical insulation between at least a portion of the power supply and the case;

k. the electrically-insulative material has a thermal conductivity of greater than $$0.7\frac{W}{m*K};$$

l. the electrically-insulative material is sealed to the case and the power supply and remains with the case and the power supply when the cap and the x-ray tube are removed from the case;

m. an air-filled third annular gap between the plug and the x-ray tube with ribs on an interior surface of the plug facing the x-ray tube.

2. An x-ray source comprising:

a. an x-ray tube and a power supply carried by an electrically-conductive case;

b. the power supply at least partially disposed in the electrically-conductive case;

c. the x-ray tube including:

i. an electrically-insulative enclosure with a cathode and an anode attached to the enclosure;

ii. an electron emitter disposed in the enclosure and associated with the cathode; and iii. a target material associated with the anode and configured to emit x-rays in response to impinging electrons from the electron emitter;

d. the electrically-conductive case including a socket in an exterior thereof;

e. the x-ray tube, electrical connections between the x-ray tube and the power supply, or the x-ray tube and the electrical connections together, extend through the socket;

f. an electrically-conductive cap:

i. carrying the x-ray tube and attaching the x-ray tube to the case;

ii. removably received at the socket of the case forming an electrically and thermally conductive path between the cap and the case;

iii. being elongated and annular with a hollow therein; and iv. having an outer end opening and an inner end opening;

g. the anode of the x-ray tube attached to the cap and forming a thermally and electrically conductive path between the cap and the anode;

h. the x-ray tube oriented to direct x-rays outward from the outer end opening; and i. a portion of the x-ray tube extending through the hollow of the cap towards the inner end opening with a first annular gap separating a portion of the x-ray tube from a portion of the cap and providing electrical insulation between the portion of the cap and the portion of the x-ray tube.

3. The x-ray source of claim 2, wherein the cap blocks 99.9% of all impinging x-rays having energy of less than 20 KeV.

4. The x-ray source of claim 2, wherein:

a. the case and the cap carrying the x-ray tube define a coupling where the cap and the case mate to couple the x-ray tube to the power supply;

b. the coupling has a first configuration when the x-ray tube and power supply are configured for a first bias voltage;

c. the coupling has a different second configuration when the x-ray tube and power supply are configured for a second bias voltage; and d. the cap and the case in the first configuration cannot mate with the case and the cap, respectively, of the coupling in the different second configuration.

5. The x-ray source of claim 2, wherein the socket has a depth of at least 10 millimeters.

6. The x-ray source of claim 2, wherein:

a. the case includes a housing substantially circumscribing the power supply with at least four contiguous side walls and a face plate at an open end of the contiguous side walls;

b. the face plate is attached to the contiguous side walls across the open end;

c. the socket is disposed in the face plate;

d. the socket has a depth of at least 8 millimeters.

7. The x-ray source of claim 2, wherein the cap extends beyond an outer face of the case for a distance of at least 3 millimeters to allow removal of the cap by grasping the cap and turning by hand without tools.

8. The x-ray source of claim 2, wherein the x-ray tube is connected to the cap by adhesive comprising silver suspended in a resin.

9. The x-ray source of claim 2, further comprising an annular, electrically-insulative, solid plug disposed in the first annular gap between the x-ray tube and the cap.

10. The x-ray source of claim 2, wherein:

a. the x-ray tube extends into the socket;

b. a region of the socket extending from an exterior of the case partially towards an interior of the case defines an outer region;

c. a region of the socket extending from the interior of the case partially towards the exterior of the case defines an inner region;

d. the cap disposed is at least partially in the outer region of the socket and the x-ray tube extends from the cap, through the outer region, and through the inner region;

e. a second annular gap separates the x-ray tube from the case at the inner region; and f. an annular, electrically-insulative, solid plug is disposed in the first annular gap and the second annular gap and electrically insulates the x-ray tube from the case at the inner region and electrically insulates a portion of the x-ray tube from the case and a portion of the x-ray tube from the cap.

11. The x-ray source of claim 10, wherein material of the plug is an electrically-insulative material and extends around and provides electrical insulation between at least a portion of the power supply and the case.

12. The x-ray source of claim 11, wherein the electrically-insulative material has a thermal conductivity of greater than $$0.7\frac{W}{m*K}.$$

13. The x-ray source of claim 10, further comprising:

a. an air-filled third annular gap between the plug and the x-ray tube; and b. ribs on an interior surface of the plug facing the x-ray tube.

14. The x-ray source of claim 2, wherein the cap is removably received in the socket of the case.

15. The x-ray source of claim 2, wherein the anode is disposed in the outer end opening of the cap.

16. An x-ray source comprising:

a. an x-ray tube and a power supply carried by an electrically-conductive case;

b. the power supply at least partially disposed in the electrically-conductive case;

c. the x-ray tube including:

i. an electrically-insulative enclosure with a cathode and an anode attached to the enclosure;

ii. an electron emitter disposed in the enclosure and associated with the cathode; and iii. a target material associated with the anode and configured to emit x-rays in response to impinging electrons from the electron emitter;

d. the electrically-conductive case including a socket in an exterior thereof;

e. the x-ray tube, electrical connections between the x-ray tube and the power supply, or both, extend into the socket; and f. an annular electrically-conductive cap having a hollow therein:

i. carrying the anode of the x-ray tube in the hollow;

ii. removably received at the socket of the case;

iii. forming a thermally and electrically conductive path between the cap and the anode and between the cap and the case; and iv. extending beyond an outer face of the case for a distance of at least 3 millimeters to allow removal of the cap by grasping the cap and turning by hand without tools.

17. The x-ray source of claim 16, wherein the socket has a depth of at least 10 millimeters.

18. The x-ray source of claim 16, wherein:

a. the electrically conductive cap is elongated and includes an outer end opening and an inner end opening, the outer end opening being the hollow in which the anode is carried;

b. the x-ray tube extends from the outer end opening towards the inner end opening;

c. a first annular gap separates a portion of the x-ray tube from a portion of the cap and provides electrical insulation between the portion of the cap and the portion of the x-ray tube; and d. an annular, electrically-insulative, solid plug disposed in the first annular gap.

19. The x-ray source of claim 18, wherein:

a. the x-ray tube extends into the socket;

b. a region of the socket extending from an exterior of the case partially towards an interior of the case defines an outer region;

c. a region of the socket extending from the interior of the case partially towards the exterior of the case defines an inner region;

d. the cap is disposed at least partially in the outer region of the socket and the x-ray tube extends from the cap, through the outer region, and through the inner region;

e. a second annular gap separates the x-ray tube from the case at the inner region; and f. the plug extends into the second annular gap and electrically insulates the x-ray tube from the case at the inner region and electrically insulates a portion of the x-ray tube from the case and a portion of the x-ray tube from the cap.

20. The x-ray source of claim 19, wherein material of the plug is an electrically-insulative material and:

a. extends around and provides electrical insulation between at least a portion of the power supply and the case; and b. has a thermal conductivity of greater than $$0.7\frac{W}{m*K}.$$

* * * * *